United States Patent [19]

Richardson

[11] Patent Number: 5,033,356

[45] Date of Patent: Jul. 23, 1991

[54] FIREARM WITH NOISE SUPPRESSOR

[76] Inventor: H. Gary Richardson, Rte. 1, Box 132C, Corpus Christi, Tex. 78414

[21] Appl. No.: 477,442

[22] Filed: Jan. 16, 1990

[51] Int. Cl.[5] ..... F41A 21/30

[52] U.S. Cl. ..... 89/14.4; 181/223

[58] Field of Search ..... 89/14.05, 14.4; 181/223

[56] References Cited

U.S. PATENT DOCUMENTS

| | | | |
|---|---|---|---|
| 812,140 | 2/1906 | Kent | 89/14.4 |
| 971,083 | 9/1910 | Shipley | 89/14.4 |
| 1,018,720 | 2/1912 | Maxim | 89/14.4 |
| 1,190,107 | 7/1916 | Carroll | 89/14.4 |
| 1,229,675 | 6/1917 | Thompson | 89/14.4 |
| 1,331,474 | 2/1920 | Master | 89/14.4 |
| 2,448,382 | 8/1948 | Mason | 89/14.4 |
| 2,801,416 | 8/1957 | Evans et al. | 89/14.05 |
| 4,126,077 | 11/1978 | Quesnel | 89/14.05 |
| 4,501,189 | 2/1985 | Brandl et al. | 89/14.4 |

*Primary Examiner*—Stephen C. Bentley

*Attorney, Agent, or Firm*—G. Turner Moller

[57] ABSTRACT

A noise suppressed firearm includes a closed chamber of fixed volume in communication with the barrel bore at a location nearer the breech than the muzzle. The closed chamber communicates with the barrel bore through passage means having a cross-sectional area at least as large as the barrel bore. The passage means communicates with the barrel bore at a location measured from the breech not greater than about 30% of the barrel length.

9 Claims, 2 Drawing Sheets

FIREARM WITH NOISE SUPPRESSOR

This invention relates to a novel noise suppressed firearm.

Noise suppressors or silencers for firearms have been proposed and made for many decades. Noise suppressors are very popular on varmint rifles because one shot drives varmints underground for hours while noise suppressed rifles can be fired many times before the game becomes wary. The standard noise suppressor was originally proposed by Hiram Maxim and present commercially available silencers are manifest descendants. These suppressors are mounted on the muzzle end of a firearm so the round or shot and all propellant gases pass through the suppressor. These suppressors are basically mufflers. Disclosures of these typical firearm noise suppressors are found in U.S. Pat. Nos. 916,885; 958,934; 958,935; 1,229,675; 2,449,571; and 3,713,362. Disclosures of some interest to this invention are found in U.S. Pat. Nos. 812,140; 971,083; 1,018,720; 1,331,474; and 2,448,382.

There are three major sources of noise created upon discharge of a firearm: (1) movement of the mechanism, i.e. firing pin, bolt and the like; (2) muzzle blast; and (3) movement of the bullet through the air at supersonic velocity. The suppressor of this invention does not reduce or affect noise caused by movement of the firearm mechanism. Indeed, in a well designed application of this invention, a large part of the remaining noise is from the mechanism. The suppressor of this invention reduces noise from the travel of supersonic rounds through air because, in most situations, it reduces the velocity of the round to a subsonic velocity. The suppressor of this invention reduces noise from muzzle blast for reasons which are only partially understood.

The noise suppressor of this invention comprises a closed chamber communicating with the barrel bore at a location nearer the breech than the muzzle. The passage or port connecting the barrel bore and the closed chamber have a cross-sectional area greater than the barrel bore. The shape of the closed chamber does not appear to affect operation of the device. The exact optimum size of the closed chamber is subject to considerable variation, in direct response to the size of the powder charge and bore caliber and, oddly, in inverse response to barrel length. While not intending to be bound by any theory of operation, it appears that the noise suppressor of this invention sets up a wave pattern that is out of phase with muzzle blast noise whereby the induced wave pattern and the muzzle blast wave pattern tend to cancel out. There is probably some noise suppression due to expansion and cooling of powder gases in the closed chamber.

In summary, this invention is a noise suppressed firearm comprising a barrel having a breech providing a chamber therein defining the diameter and length of a projectile fired from the firearm, a muzzle, a bore between the breech and muzzle having a predetermined cross-sectional area and passage means intersecting the bore at a location, measured from the breech, not more than about 30% of the distance from the breech to the muzzle and having a cross-sectional area greater than the bore, the passage means having a length, in the direction of the bore, not more than about five projectile lengths; and a closed chamber communicating with the passage means and being empty except of gas.

In summary, this invention is a noise suppressed firearm comprising a barrel having a breech, a muzzle, a bore between the breech and muzzle having a predetermined cross-sectional area and passage means intersecting the bore, a noise suppressor comprising a closed chamber of fixed volume operative to suppress noise when in communication with the passage means, and valve means for selectively connecting the closed chamber from the bore for enabling the noise suppress and for isolating the closed chamber from the bore for disabling the noise suppressor.

In summary, this invention is a silenced firearm comprising a barrel having a breech, a muzzle, a bore between the breech and muzzle having a predetermined cross-sectional area and passage means intersecting the bore at a location, measured from the breech, not more than about 30% of the distance from the breech to the muzzle and having a cross-sectional area greater than the bore, and a closed chamber communicating with the passage means and being empty except of gas, the barrel ending at the muzzle and the closed chamber comprising the sole noise suppressor.

One object of this invention is to provide a firearm having an improved noise suppressor or silencer.

Another object of this invention is to provide an improved noise suppressor for a firearm comprising a simple closed chamber of fixed volume communicating with the barrel bore through passage means sized and spaced to be effective.

Another object of this invention is to provide an improved noise suppressor for a firearm comprising a closed chamber which can be disabled by closing a valve isolating the closed chamber from the barrel bore.

Other objects and advantages of this invention will become more fully apparent as this description proceeds, reference being made to the accompanying drawings and appended claims.

IN THE DRAWINGS

Figure 1:
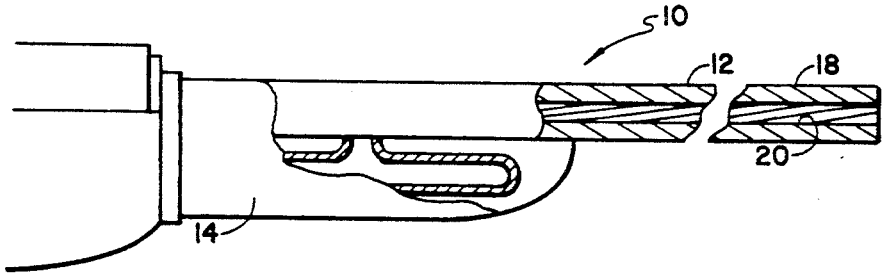
FIG. 1 is a side elevational view, partly in section, of a firearm equipped with a noise suppressor of this invention.
Figure 2:
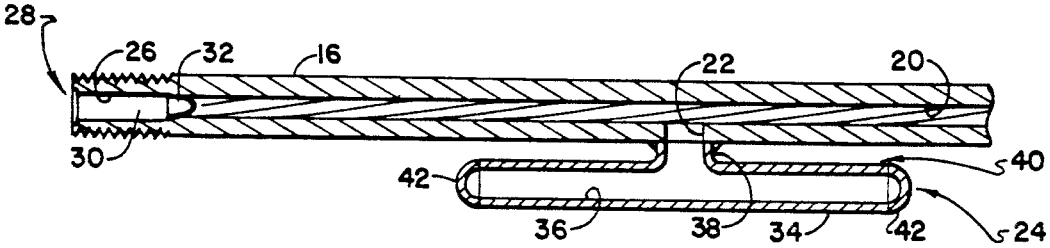
FIG. 2 is an enlarged cross-sectional view of the firearm of FIG. 1, taken substantially along line 2—2 thereof, as viewed in the direction indicated by the arrows.

Referring to FIGS. 1–2, a rifle 10 includes a barrel 12 supported in a stock 14 and having a breech 16 threaded into the frame (not shown) of the rifle 10, a muzzle 18 and a rifled bore 20. One or more ports or passages 22 have been drilled through the barrel 12 into the bore 20. The passage 22 is at least as large and is preferably larger than the bore 20. As will be discussed more fully hereinafter, the cross sectional area of the passage 22 and the location of the passage 22 have considerable bearing on operation of the noise suppressor 24. The rifle 10 may be of any suitable caliber and is illustrated as being 0.22 caliber having a chamber 26 at the breech end receiving a round 28 comprising a cartridge case 30 and a bullet 32. Those skilled in the art realize that the size and shape of the chamber 26 and the size of the bore 20 dictate the length of the bullet 32, the importance of which will be apparent shortly.

The noise suppressor 24 comprises a sealed or closed chamber 34 having an elongate unrestricted cylindrical passage 36 therein communicating with the passage 22 through a fitting or stub conduit 38. The chamber 34 comprises a tubular member 40 closed at each end in any suitable fashion, as by end caps 42 welded thereto, and is empty, except for air. Where the port 22 is sized and placed correctly and the chamber 34 is of sufficient size, noise produced by the rifle 12 is considerably reduced.

Figure 3:
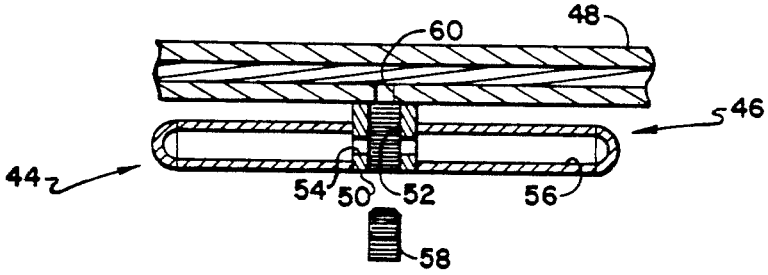
FIG. 3 is a cross-sectional view similar to FIG. 2, illustrating another embodiment of this invention.

FIG. 3 illustrates a modification of FIG. 1–2 allowing the noise suppressor 44 to be disabled in a simple and efficient manner The tubular member 46 is connected to the barrel 48 by a fitting or stub conduit 50 which extends across the diameter of the member 46. The fitting 50 is welded to the barrel 48 and to the tubular member 46 and provides an internal threaded passage 52 providing a series of openings 54 communicating between the passage 56 in the tubular member and the interior of the fitting 50. To enable the noise suppressor 44, the threaded plug 58, such as an Allen screw, is backed out of the passage 52 to uncover the openings 54 and allow communication between the passage 52 and the openings 54. To disable the noise suppressor 44, the user merely threadably advances the plug 58 to close the openings 54 and disrupt communication between the passage 56 and the port 60 opening into the barrel bore. It will be seen that the threaded passage 52 and openings 54 act as a valve seat while the plug 58 acts as a valve. The size of the openings 54 does not appear to affect operation of the noise suppressor 44.

A 0.22 calaber Marlin bolt action rifle was modified in accordance with FIG. 3 and fired with standard 0.22 long rifle high velocity 1375 fps ammunition. At the time the tests were conducted, the wind was blowing to produce a variable ambient noise level of 54–60 decibels. Measurements were made with a Realistic Brand Decibel Meter from Radio Shack positioned at right angles to bullet travel about three feet away. Some tests were made with the meter 30' in front of the weapon, some 5'. The weapon was fired from a location between vertical styrofoam pallets covered with a horizontal styrofoam pallet. The meter was placed on a support between similar pallets. This type meter has a selection switch to set the sensitivity at 50, 60, 70, 80, 90, 100, 110 or 120 decibels and a needle registering plus or minus from the set value. This introduced a difficulty when firing unsuppressed because the background noise was off scale and could not be read. The data is in Table I.

TABLE I

| | | .22 caliber | | |
|---|---|---|---|---|
| | meter to | ambient | weapon condition | |
| round | firearm | noise | suppressed | unsuppressed |
| 3 | 30' | 54 | 62 | |
| 4 | 30' | 54 | 63 | |
| 5 | 30' | 54 | 62 | |
| 6 | 30' | 60 | 64 | |
| 7 | 30' | 54 | 62 | |
| 8 | 30' | 54 | | off scale |
| 9 | 30' | low | | 84 |
| 10 | 30' | low | | 83 |
| 11 | 30' | low | | 85 |
| 12 | 30' | low | | 84 |
| 13 | 5' | low | | 83 |

TABLE I-continued

| | | .22 caliber | | |
|---|---|---|---|---|
| | meter to | ambient | weapon condition | |
| round | firearm | noise | suppressed | unsuppressed |
| 14 | 5' | low | | 82 |
| 15 | 5' | low | | 83 |
| 16 | 5' | low | | 83 |
| 17 | 5' | 54 | 66 | |
| 18 | 5' | 54 | 65 | |
| 19 | 5' | 54 | 64 | |
| 20 | 5' | 56 | 63 | |
| cycle bolt | 5' | 54 | 62 | |
| cycle bolt | 5' | 54 | 61 | |
| dry fire | 5' | 56 | 59 | |

Figure 4:
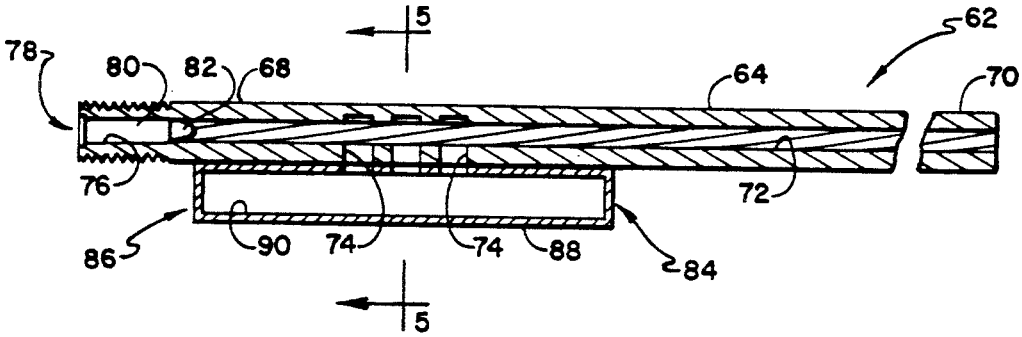
FIG. 4 is a cross-sectional view similar to FIGS. 2 and 3, illustrating another embodiment of this invention.

Referring to FIG. 4, there is shown a rifle 62 comprising another embodiment of this invention including a barrel 64 supported in a stock 66 having a breech end 68 threaded into the frame (not shown) of the rifle 62, a muzzle end 70 and a rifled bore 72. The barrel 62 has been modified by drilling three aligned axially spaced ports or passages 74 into the bore 70. The cumulative cross sectional areas of the passages 74 are at least as large as that of the bore 70 and, preferably, the diameter of each of the passages 74 exceeds the diameter of the bore 72. As discussed more fully hereinafter, the location of the passages 74 is in a particular location. Although the rifle 62 may be of any suitable caliber, the barrel 64 is illustrated as being 0.22 caliber having a chamber 76 at the breech end receiving a round 78 comprising a cartridge case 80 and a bullet 82. It will be apparent to those skilled in the art that the size and shape of the chamber 76 and the size of the bore 72 dictate the length of the bullet 82, the importance of which will be more fully apparent hereinafter.

Figure 5:
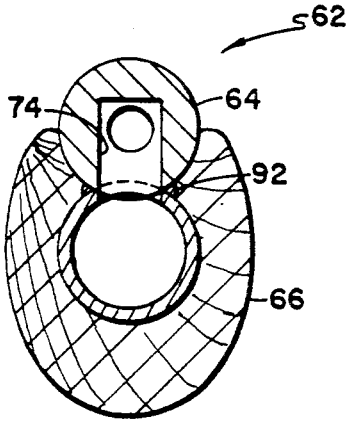
FIG. 5 is a transverse cross-sectional view of FIG. 4, taken along line 5—5 thereof, as viewed in the direction indicated by the arrows.

The noise suppressor or silencer 84 comprises a sealed or closed chamber 86 including an elongate tubular member 88 having an elongate unrestricted circular passage 90 therein communicating with the passages 74. Conveniently, the tubular member 88 is welded to the bottom of the barrel 64 as shown by the weldments 92 in FIG. 5. The chamber 86 is empty, except for air.

Figure 6:
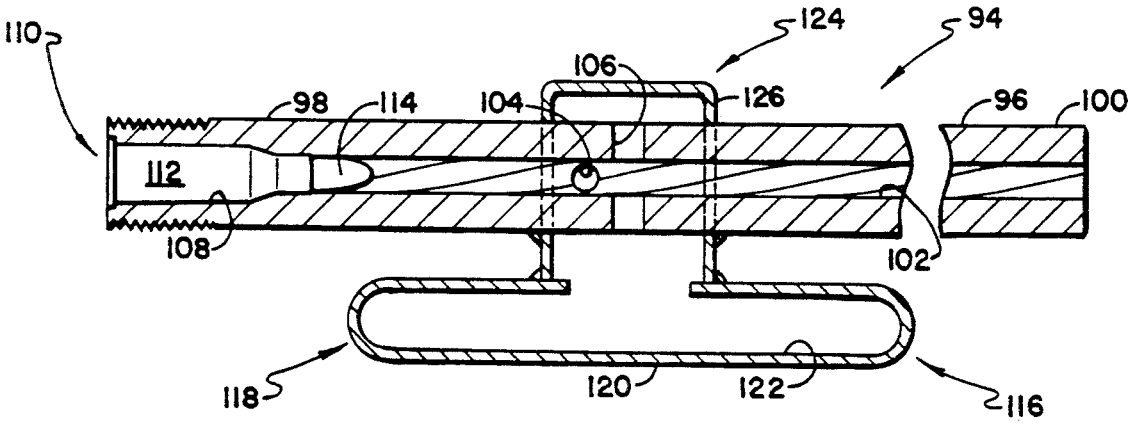
FIG. 6 is a cross-sectional view similar to FIGS. 2–4, illustrating another embodiment of this invention.

Referring to FIG. 6, there is shown a rifle 94 comprising another embodiment of this invention including a barrel 96 having a breech end 98 threaded into the frame (not shown) of the rifle 94, a muzzle end 100 and a rifled bore 102. The barrel 96 has been modified by drilling a pair of passages 104, 106 through the bore 102. The cumulative cross sectional areas of the passages 104, 106 are at least as large as that of the bore 102. As discussed more fully hereinafter, the passages 104, 106 are in a particular location. Although the rifle 94 may be of any suitable caliber, the barrel 96 is illustrated as being 9 mm caliber having a chamber 108 at the breech end receiving a round 110 comprising a cartridge case 112 and a projectile 114. In a model built in accordance with FIG. 9, the passages 104, 106 are each 0.200" in diameter. It will be apparent to those skilled in the art that the size and shape of the chamber 108 and the size of the bore 102 dictate the length of the projectile 114, the importance of which will be more fully apparent hereinafter.

The noise suppressor or silencer 116 comprises a sealed or closed chamber 118 including an elongate tubular member 120 having an elongate unrestricted circular passage 122 therein communicating with the passages 104, 106 though a fitting or cap 124. The fitting 124 comprises a generally annular section 126 receiving the barrel 96 therethrough and having an open bottom 128 to which the tubular member 120 is welded. The chamber 122 is empty, except for air. A Colt Version, AR-15, 9 mm rifle was modified after FIG. 6. Tests on this firearm, were conducted at the same time and under the same conditions as shown in Table I. The ammunition used was 9 mm, 124 grain, full metal jacket, factory duplicate load, 1096 fps. The unsuppressed noise results were obtained by firing the same ammunition in an unsuppressed 9 mm Smith & Wesson pistol.

TABLE II

| | | 9 mm | | |
|---|---|---|---|---|
| | | | weapon condition | |
| round | meter to firearm | ambient noise | suppressed rifle | unsuppressed pistol |
| 1 | 5' | low | 92 | |
| 2 | 5' | low | 91 | |
| 3 | 5' | low | 91 | |
| 4 | 5' | low | | 110 |
| 5 | 5' | low | | 109 |
| 6 | 5' | low | | 109 |
| 7 | 30' | low | 82 | |
| 8 | 30' | low | 80 | |
| 9 | 30' | low | 82 | |
| 10 | 30' | low | 80 | |
| 11 | 30' | low | | off scale |
| 12 | 30' | low | | 98 |
| 13 | 30' | low | | 97 |
| 14 | 30' | low | | 98 |
| 15 | 30' | low | | 98 |

The noise suppressors of this invention are useful on a wide range of firearms, including rifles, shotguns and pistols. The noise suppressors of this invention have several characteristics in common. First, the chambers are sealed and are of a sufficient volume. So far as can be determined, the shape of the chamber is immaterial. Successful results have been obtained with elongate chambers parallel to the barrel as illustrated, elongate chambers perpendicular to the barrel and annular chambers surrounding the barrel. The size of the chamber may vary widely. The optimum size of the chamber increases with increasing powder charge but decreases with increasing barrel length. Two examples of optimum construction are as follows:

TABLE III

| | Chamber volume in cubic inches | |
|---|---|---|
| barrel length | .22 caliber | 9 mm caliber |
| 12 in | 2.500 ± .250 | 6.585 ± .250 |
| 14 in | 2.250 ± .250 | 5.927 ± .250 |
| 16 in | 2.000 ± .250 | 5.268 ± .250 |
| 18 in | 1.750 ± .250 | 4.610 ± .250 |
| 20 in | 1.500 ± .250 | 3.951 ± .250 |
| 22 in | 1.250 ± .250 | 3.293 ± .250 |
| 24 in | 1.000 ± .250 | 2.634 ± .250 |
| 26 in | .750 ± .250 | 1.976 ± .250 |
| 28 in | .500 ± .250 | 1.317 ± .250 |

Analysis of the volumes for 0.22 and 9 mm shows they are proportional to the areas of the bore. The reason is that the muzzle velocities are about the same, i.e. 1100–1300 fps. A direct ratio based on area alone does not apply for, for example, 0.45 caliber 900–1000 fps firearms, 0.44 magnum 1400–1500 fps firearms or high speed firearms having 1500–4000 fps muzzle velocities. The higher velocity firearms require larger chamber volumes.

Second, the passages or ports providing communication between the barrel bore and the noise suppressor are at least as large in cross-sectional area as the barrel bore and preferably are larger. The reason is not known. The speculation is that the area has to be as large or larger or else the powder gases will travel down the barrel and not substantially enter the closed chamber.

Third, the position of the passages on the barrel are less than about 30% of barrel length from breech to muzzle and preferably 25% of barrel length. The position of the passages on the barrel has two effects. First, the position of the first passage nearest the breech limits the muzzle velocity of the projectile. In many situations, it is desirable to reduce the muzzle velocity below the sonic velocity of 1100 feet per second. The muzzle velocity of most otherwise supersonic velocity rounds can be readily reduced below sonic velocity by placing the first port at a location where the projectile has not yet achieved sonic velocity. Thus, how close the first passage is placed to the breech is dictated by the desired muzzle velocity of the projectile Second, if the first passage is too far from the breech, the noise suppressors of this invention do not operate to reduce muzzle blast significantly, at least in the calibers and combinations where it has been tried. An optimum design positions the passages on the barrel at a 1:4 ratio, i.e. the distance from the breech to the first passage is one fourth barrel length. Effective noise suppressors have been made where the passages are at a 3:10 ratio but effectiveness seems to be lost where the ratio approaches 1:3.

For simplicity of manufacture, it is preferred that a single passage connect the barrel bore and the noise suppressor of this invention. Preferably, the single passage is shorter than one projectile length. It is known, however, that multiple passages are operative in a wide range of sizes and patterns, as shown by the embodiments of FIGS. 4 and 6. It is known that the passages cannot be strung along a great length of the barrel because the powder gases will bypass the projectile and travel through the noise suppressor to exit through the muzzle. Thus, the passages do not extend along the barrel length for more than a short distance, most easily expressed as some multiple of projectile length. The passages do not extend along the barrel for more than about five projectile lengths and preferably do not extend more than three projectile lengths.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A noise suppressed firearm comprising a barrel having a breech providing a chamber therein defining the diameter and length of a projectile fired from the firearm, a muzzle, a bore between the breech and muzzle having a predetermined cross-sectional area and a signal passage perpendicularly intersecting the bore at a location, measured from the breech, not more than about 30% of the distance from the breech to the muzzle and having a cross-sectional area greater than the bore, the passage having a length shorter than the projectile; and a closed chamber of fixed volume communicating with the passage means and being empty except of gas, the single passage comprising the sole communication between the bore and the closed chamber.

2. The noise suppressed firearm of claim 1 wherein the closed chamber comprises a stub conduit, surrounding the single passage, having a first end secured to and extending away from the barrel, and a second end, the closed chamber comprising a generally cylindrical member generally parallel to the barrel and connected to the stub conduit second end.

3. The noise suppressed firearm of claim 1 wherein the stub conduit includes a threaded central passage having one end communicating with the barrel bore and a branch passage transverse to the central passage opening laterally through the stub conduit, the branch passage providing a valve seat and the closed chamber includes a chamber wall transverse to the stub conduit passage and further comprising a threaded member in the threaded opening for threading movement toward and away from the valve seat for selectively opening the closed chamber to the stub conduit passage and for isolating the closed chamber from the stub conduit passage.

4. The noise suppressed firearm of claim 1 wherein the bore is rifled.

5. A noise suppressed firearm comprising a barrel having a breech providing a chamber therein defining a diameter and length of a projectile fired from the firearm, a muzzle, a bore between the breech and muzzle having a predetermined cross-sectional area and a plurality of passages intersecting the bore, the passage nearest the breech being, measured from the breech, not more than about 30% of the distance from the breech to the muzzle, the passages having a cumulative cross-sectional area greater than the bore, the distance from a first passage to a last passage being less than five projectile lengths; and a closed chamber of fixed volume communicating with the passages and being empty except of gas.

6. The noise suppressed firearm of claim 5 wherein the plurality of passages comprises three adjacent passages aligned in the direction of the barrel.

7. The noise suppressed firearm of claim 5 wherein the plurality of passages comprises a first pair of adjacent passages on one side of the barrel aligned in the direction of the barrel and a second pair of adjacent passage on an opposite side of the barrel, the passages of the first pair being aligned with the passages of the second pair.

8. The noise suppressed firearm of claim 5 wherein the closed chamber is empty, except of air.

9. The noise suppressed firearm of claim 5 wherein the distance from the first passage to the last passage is less than about three projectile lengths.

* * * * *